US008530004B2

(12) United States Patent
Huang et al.

(10) Patent No.: US 8,530,004 B2
(45) Date of Patent: Sep. 10, 2013

(54) POLYMERIC ELECTRET FILM AND METHOD OF MANUFACTURING THE SAME

(75) Inventors: James Huang, Taichung (TW); Sean Chen, Taichung (TW); Radium Huang, Taichung (TW)

(73) Assignee: EF-Materials Industries Inc., Taoyuan County (TW)

( * ) Notice: Subject to any disclaimer, the term of this patent is extended or adjusted under 35 U.S.C. 154(b) by 342 days.

(21) Appl. No.: 12/732,571

(22) Filed: Mar. 26, 2010

(65) Prior Publication Data

US 2011/0186437 A1 Aug. 4, 2011

(30) Foreign Application Priority Data

Feb. 2, 2010 (TW) ..... 99102950 A

(51) Int. Cl.
*H05H 1/00* (2006.01)
*H05H 1/32* (2006.01)
*C08J 7/18* (2006.01)

(52) U.S. Cl.
USPC ..... 427/533; 427/490; 427/491; 427/535; 427/540

(58) Field of Classification Search
USPC ..... 427/490, 491, 533, 535–540; 205/95; 307/400
See application file for complete search history.

(56) References Cited

U.S. PATENT DOCUMENTS 4,046,704 A 9/1977 Sumita
5,384,337 A 1/1995 Budinger
6,489,033 B1 * 12/2002 Hatke et al. ..... 428/461
7,079,902 B2 * 7/2006 Soukup et al. ..... 607/116
2004/0195173 A1 * 10/2004 Huang et al. ..... 210/490
2006/0154010 A1 * 7/2006 Oyama ..... 428/36.9
2009/0060234 A1 * 3/2009 Liou et al. ..... 381/191
2011/0255720 A1 * 10/2011 Kao et al. ..... 381/191

OTHER PUBLICATIONS

Schwodiauer et al., Dielectric and electret properties of novel Teflon PTFE and PTFE-like polymers, 1999, IEEE, 10th International Symposium on Electrets, p. 315-316.*
Gerhard-Multhaupt et al., Porous PTFE Space-Charge Electrets for Piezoelectric Applications, Aug. 2000, IEEE transactions on Dielectrics and Electrical Insulation, vol. 7 No. 4, p. 480-488.*
Nifuku et al., Charging characteristics for electret filter materials, 2001, Journal of Electrostatics 51-52, p. 200-205.*
Xia et al., High surface-charge stability of porous polytetrafluoroethylene electret films at room and elevated temperatures, 1999, J. Phys. D: Appl. Phys. 32 L83-L85.*
Giacometti et al., Corona charging of Polymers-Recent Advances on Constant Current Charging, Jun. 1999, Brazilian Journal of Physics, vol. 29, No. 2, p. 269-279.*

* cited by examiner

*Primary Examiner* — Dah-Wei Yuan
*Assistant Examiner* — Diane Zhang
(74) *Attorney, Agent, or Firm* — Ming Chow; Sinorica, LLC

(57) ABSTRACT

Disclosed is a polymeric electret film as well as the method of manufacturing the same. The polymeric electret film comprises a polytetrafluoroethylene film and an electrode layer. The polytetrafluoroethylene film includes a porous layer, which has a porous structure. The porous structure has a pore diameter ranging between 0.01 μm and 5.0 μm and has a porosity ranging between 20% and 95%. The polytetrafluoroethylene film has a thickness ranging between 1 μm and 50 μm, and is preferably made of expanded porous polytetrafluoroethylene. The polymeric electret film has a surface potential ranging between 0.1 V and 1000 V.

13 Claims, 11 Drawing Sheets

| | Surface potential (V) | | | Decay rate of surface potential (V) | | |
|---|---|---|---|---|---|---|
| Days | Sample A | Sample B | Sample C | Sample A | Sample B | Sample C |
| 0 | 667.0 | 308.3 | 487.5 | 0.0% | 0.0% | 0.0% |
| 8 | 589.0 | 316.7 | 458.3 | 11.7% | -2.7% | 6.0% |
| 17 | 573.0 | 254.2 | 228.3 | 14.1% | 17.5% | 53.2% |
| 26 | 546.0 | 249.2 | 210.8 | 18.1% | 19.2% | 56.8% |
| 39 | 553.0 | 241.7 | 194.2 | 17.1% | 21.6% | 60.2% |
| 47 | 536.0 | 230.0 | 191.7 | 19.6% | 25.4% | 60.7% |
| 55 | 524.0 | 195.8 | 185.0 | 21.4% | 36.5% | 62.1% |
| 71 | 519.0 | 193.0 | 183.0 | 22.2% | 37.4% | 62.5% |
| 89 | 523.0 | 189.0 | 181.0 | 21.6% | 38.7% | 62.9% |
| 103 | 521.0 | 184.0 | 176.0 | 21.9% | 40.3% | 63.9% |
| 119 | 514.0 | 182.0 | 175.0 | 22.9% | 41.0% | 64.1% |
| 137 | 509.0 | 178.0 | 171.0 | 23.7% | 42.3% | 64.9% |
| 152 | 509.0 | 174.0 | 167.0 | 23.7% | 43.6% | 65.7% |
| 165 | 508.0 | 168.0 | 163.0 | 23.8% | 45.5% | 66.6% |
| 180 | 507.0 | 165.0 | 159.0 | 24.0% | 46.5% | 67.4% |
| 196 | 508.0 | 163.0 | 153.0 | 23.8% | 47.1% | 68.6% |
| 211 | 507.0 | 159.0 | 151.0 | 24.0% | 48.4% | 69.0% |

Fig. 6B

| | Surface potential (V) | | | Decay rate of surface potential (V) | | |
|---|---|---|---|---|---|---|
| Days | Sample D | Sample E | Sample F | Sample D | Sample E | Sample F |
| 0 | 520.8 | 618.3 | 598.3 | 0.0% | 0.0% | 0.0% |
| 8 | 506.7 | 565.8 | 538.3 | 2.7% | 8.5% | 10.0% |
| 17 | 450.0 | 283.3 | 191.7 | 13.6% | 54.2% | 68.0% |
| 26 | 445.8 | 280.8 | 191.7 | 14.4% | 54.6% | 68.0% |
| 39 | 420.8 | 257.5 | 190.0 | 19.2% | 58.4% | 68.2% |
| 47 | 419.2 | 250.0 | 190.0 | 19.5% | 59.6% | 68.2% |
| 55 | 418.3 | 248.3 | 190.0 | 19.7% | 59.8% | 68.2% |
| 71 | 420.0 | 246.0 | 189.0 | 19.4% | 60.2% | 68.4% |
| 89 | 418.0 | 242.0 | 184.0 | 19.7% | 60.9% | 69.2% |
| 103 | 416.0 | 237.0 | 186.0 | 20.1% | 61.7% | 68.9% |
| 119 | 416.0 | 231.0 | 191.0 | 20.1% | 62.6% | 68.1% |
| 137 | 414.0 | 226.0 | 185.0 | 20.5% | 63.4% | 69.1% |
| 152 | 416.0 | 223.0 | 191.0 | 20.1% | 63.9% | 68.1% |
| 165 | 414.0 | 218.0 | 188.0 | 20.5% | 64.7% | 68.6% |
| 180 | 413.0 | 215.0 | 187.0 | 20.7% | 65.2% | 68.7% |
| 196 | 416.0 | 209.0 | 184.0 | 20.1% | 66.2% | 69.2% |
| 211 | 415.0 | 205.0 | 175.0 | 20.3% | 66.8% | 70.8% |

Fig. 7B

| | Surface potential (V) | | Decay rate of surface potential (V) | |
|---|---|---|---|---|
| Days | Sample A | Sample G | Sample A | Sample G |
| 0 | 667.0 | 624.2 | 0.0% | 0.0% |
| 8 | 589.0 | 543.3 | 11.7% | 13.0% |
| 17 | 573.0 | 487.1 | 14.1% | 22.0% |
| 26 | 546.0 | 450.8 | 18.1% | 27.8% |
| 39 | 553.0 | 289.2 | 17.1% | 53.7% |
| 47 | 536.0 | 275.0 | 19.6% | 55.9% |
| 55 | 524.0 | 269.7 | 21.4% | 56.8% |
| 71 | 519.0 | 269.0 | 22.2% | 56.9% |
| 89 | 523.0 | 268.0 | 21.6% | 57.1% |
| 103 | 521.0 | 267.0 | 21.9% | 57.2% |
| 119 | 514.0 | 266.0 | 22.9% | 57.4% |
| 137 | 509.0 | 265.0 | 23.7% | 57.5% |
| 152 | 509.0 | 264.0 | 23.7% | 57.7% |
| 165 | 508.0 | 262.0 | 23.8% | 58.0% |
| 180 | 507.0 | 261.0 | 24.0% | 58.2% |
| 196 | 508.0 | 263.0 | 23.8% | 57.9% |
| 211 | 507.0 | 262.0 | 24.0% | 58.0% |

Fig. 8B

POLYMERIC ELECTRET FILM AND METHOD OF MANUFACTURING THE SAME

BACKGROUND OF THE INVENTION

1. Technical Field

The present invention relates to an electret, and more particularly to a polymeric electret film and method of manufacturing the same. The polymeric electret film obtained by such method is capable of remarkably improving the polarized initial surface potential and greatly lower the surface potential decay rate.

2. Description of Related Art

An electret is broadly defined as a dielectric material, which exhibits an external electric field in the absence of an applied field. The term "electret" is used as a generic name for the materials which can retain static electric charges for the long-term period. Electret materials can be easily found in our daily life. Today, most electrets are made from dielectric materials, e.g. polypropylene (PP), fluoropolymers, fluorinated ethylene-propylene (FEP), polytetrafluoroethylene (PTFE) and polyvinylidene fluoride (PVDF), etc. These dielectric materials can permanently retain the static electric charges after they are electrized, thus existing as the so-called electrets.

Electrets can permanently retain two types of space charges, one being dipole charges and the other being real charges, both of which exist simultaneously in the electret. Real charge electrets are those that possess an injected or imbedded charge within the dielectric. Dipolar electrets, as their name suggests, are formed by the orientation of dipoles (i.e. polar groups) within the dielectric. Real charge electrets are typically formed by techniques that deposit or inject charge directly into the dielectric material. Dipolar electrets are formed, or polarized, by the application of an electric field to the material either at ambient temperature, or by heating the material to a higher temperature while applying an external electric field and then cooling to some lower temperature while the external field is maintained. In dipolar electrets, the reorientation of electrical polarization can only be achieved at temperatures where the dipoles are mobile. For most polymers of interest this occurs above the glass transition temperature. Dipolar electrets can also be formed by charge injection techniques wherein the electric field due to the imbedded charge causes dipole reorientation.

Real charges include surface charges and space charges. Surface charges deposits at or near the surface of dielectric materials. As being exposed to the ambient environment, surface charges are difficult to retain and usually temporarily stay on the dielectric materials. On the other hand, since space charges are retained inside the dielectric materials and are unlikely to lose as compared with surface charges, they can be retained in the dielectric materials permanently.

There are two types of real charge electrets, one being homo charge electrets and the other being hetero charge electrets. Hetero charge means that the polarity of the space charge is opposite to that of neighboring electrode, and homo charge is the reverse situation. Under high voltage application, a hetero charge near the electrode is expected to reduce the breakdown voltage, whereas a homo charge will increase it. After polarity reversal under ac conditions, the homo charge is converted to hetero space charge.

While there have been many approaches to charging electret materials, three major techniques are discussed herein:

1. Corona charging, as its name implies, involves the application of a corona charging to the implantation of charge in a dielectric material. Corona charging relies on the breakdown characteristics of the gas present in the gap between a pair of electrodes. The majority of the energy dissipated within the corona charging goes to the excitation of the gas. These charge carriers deposit charge on the dielectric surface at depths of only a few nanometers. Over time, charge trapped at the surface can move into the bulk and become retrapped at depths of several microns.

2. Thermal charging, as its name implies, involves the application of an electric field to a dielectric material at elevated temperature and subsequent cooling while the field is maintained. In electrets prepared from polar dielectrics, where the electrodes are vapor deposited directly on the dielectric material, the thermal charging gives rise to dipole orientation. However, the use of external electrodes results in air gaps at the dielectric/electrode interface that can lead to very complicated charging phenomena. Electrets made using this charging method are called thermoelectrets.

3. Electron beams charging, as its name implies, have been used for the charging of film electrets, but typically not used for charging nonwoven or fibrous filtration media. Charge implantation with low energy electron or ion beams relies on the generation of a secondary electron cascade as a result of scattering of the primary beam within the bulk of the dielectric. Low energy secondary electrons and the slowed down primaries become trapped within the dielectric yielding an electret state, which depending on the material can have a very high stability. High-energy electron and ion beams (i.e. ionizing radiation) do not work well for electret charging because of the chemical damage caused to most dielectric materials as a result of radiation exposure. The damage leads to induced conductivity that destabilizes the implanted charge leading to recombination of positive and negative centers.

Electrets are extensively applicable throughout various industries including exercising equipment, acoustics, optics, medical treatment and electrics. They are photoelectrically used for touch screens and X-Y positioning applications. Their medical applications include audiphones and filter masks. For electroacoustic use, electrets can be seen in super slim loud speakers (SSLSs), cap speakers, amplifiers, microphones, earphones, and voice transmitters. In addition, electrets are also widely used in piezoelectric power generators, switches, motors, power generators, various transducers, high-voltage power sources, detectors and solar batteries.

Recently, electrets attract great attention as a biomedical material that contributes the so-called electret effect. For instance, since the human vessel wall is negatively charged, the negative charge deposition of electrets may be used to improve blood compatibility of polymers, thereby providing antithrombotic effect and facilitating growth of bones and synthetic membrane texture. Another important breakthrough of electrets is their application to electrophotography, which contributes to the development of electrostatic recording technology. Meantime, the electret effect has been found in important biopolymers, such as protein, polysaccharide and some coenocytes. In addition, many important biomolecules, such as haemoglobin and deoxyribonucleic acid (DNA), may have various polarized and charge storage areas.

A charged electret is in fact a polarized dielectric of a metastable state with a relatively long relaxation time. However, when the additional electric field is removed, the charge storage volume is gradually reduced and the charges decay along the exponential curve gradually. Under the room temperature, the type of electrets dominates how its polarization remains while a relatively high temperature can lead to quick decay of electret's charge storage volume. Hence, it would be an important issue to improve decay of electret's charge storage volume in high-temperature environment.

Electret polymer materials are required to be long-term stable and less sensitive to moisture or chemicals. Traditionally, while hydrocarbon polymer materials, such as polypropylene, polyethylene or polycarbonate, are relatively inexpensive and processible, and have good chemical resistance as well as mechanical properties, as electrets, they suffer from serious decay of charge storage volume and shortened service life, thus being incompetent for long-term effective applications. Perfluoropolymers, such as fluoropolymers, fluorinated ethylene-propylene (FEP) and polytetrafluoroethylene (PTFE), do have long-term stability, but are expensive and insoluble to solvents, thus being less processible and having their application scope limited. Therefore, there is a need for a material, when used as an electret, has long-term stability and is less sensitive to moisture or chemicals, wherein the electret shall have significantly improved decay of charge storage volume in high-temperature environment.

U.S. Pat. No. 4,046,704 discloses an electrets film made of poly-3,3-bis(chloromethyl)-oxacyclobutane with a thickness of 200 μm with initial surface potential approximately 600V when disposed in an electric field of 2000V at 160° C. and then cooled to room temperature. The surface potential decay of the film 30 days from polarization is not obvious but convincing data are again not provided. The initial surface potential of the film is also unclear.

In addition, U.S. Pat. No. 5,384,337 discloses a binder mixture having PTFT as electret particles, PU, and DMF. A matrix of fibers is impregnated with the mixture and cured, whereby the electrets are substantially uniformly distributed throughout the matrix to produce an electrostatic porous material. However, U.S. Pat. No. 5,384,337 does not disclose any data regarding surface potential decay, resulting in the performance of the electrostatic porous material remaining unknown.

Therefore, it is desirable to provide a polymeric electret film capable of remarkably improving the polarized initial surface potential and greatly lower the surface potential decay rate.

SUMMARY OF THE INVENTION

To overcome the shortcomings of the prior arts mentioned above, the present invention provides a polymeric electret film and method of manufacturing the same.

Accordingly, the primary object of the present invention is to provide a polymeric electret film and method of manufacturing the same. The polymeric electret film comprises a polytetrafluoroethylene film and an electrode layer. The polytetrafluoroethylene film includes a porous layer, which has a porous structure. The porous structure has a pore diameter ranging between 0.01 μm and 5.0 μm and has a porosity ranging between 20% and 95%. The polytetrafluoroethylene film has a thickness ranging between 1 μm and 50 μm, and is preferably made of expanded porous polytetrafluoroethylene. The obtained polymeric electret film is capable of improving the polarized initial surface potential and lowering the surface potential decay rate.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein:

FIG. 6B is the results showing the surface potential and the charge stability of the polymeric electret film of the first preferred embodiment's experimental example 2.

FIG. 7B is the results showing the surface potential and the charge stability of the polymeric electret film of the first preferred embodiment's experimental example 3.

FIG. 8B is the results showing the surface potential and the charge stability of the polymeric electret film of the first preferred embodiment's experimental example 3.

DETAILED DESCRIPTION OF THE PREFERRED EMBODIMENT

Some particular features of the invention will be described in detail for purpose of illustration, and one of ordinary skill in the art can easily understand the advantages and efficacy of the present invention through the disclosure of the specification. It is to be understood that alternative embodiments may be possible for the implement and application of the present invention while numerous variations will be possible to the details disclosed in the specification on the strength of diverse concepts and applications without going outside the scope of the invention as disclosed in the claims.

Figure 1:
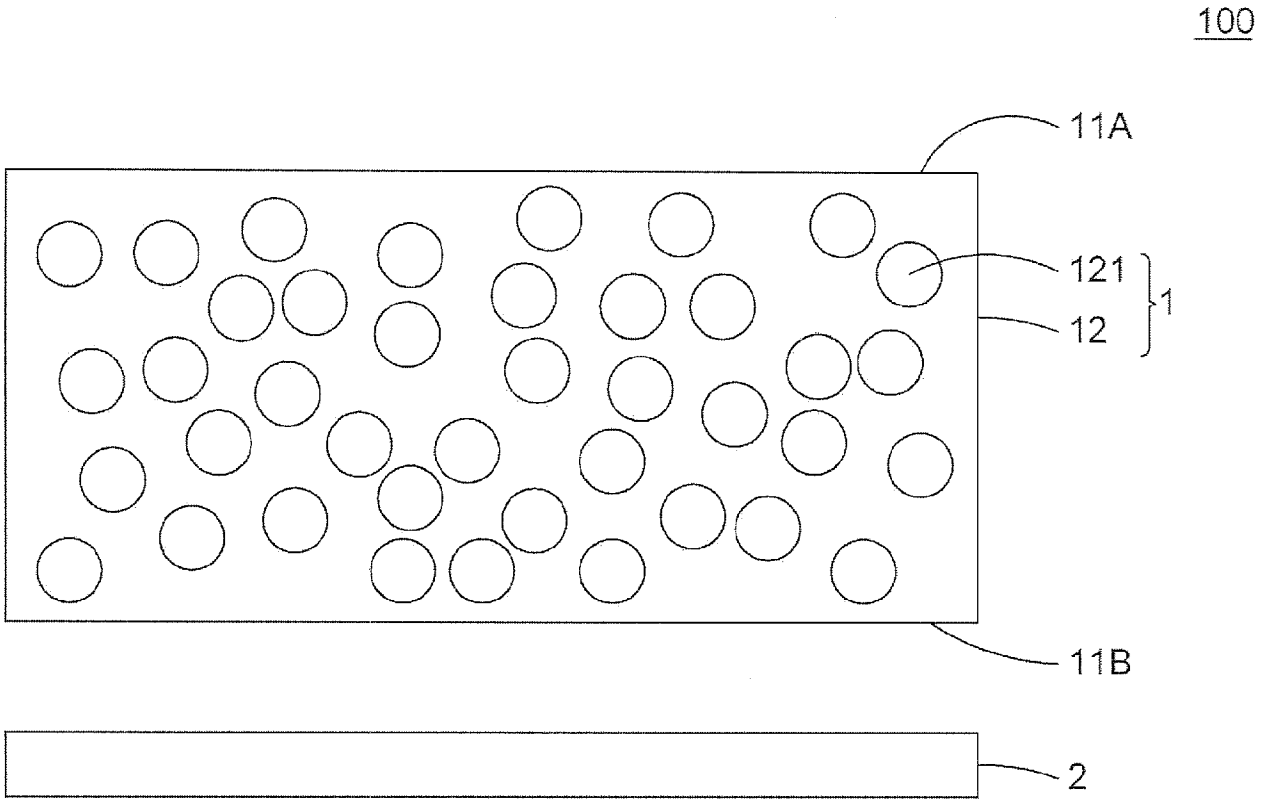
FIG. 1 is a cross-sectional view of a polymeric electret film according to the first preferred embodiment of the present invention.

Please refer to FIG. 1. The first preferred embodiment of the present invention is a polymeric electret film 100. The polymeric electret film 100 comprises a polytetrafluoroethylene film 1 and an electrode layer 2. The polytetrafluoroethylene film 1 includes a porous layer 12, which has a porous structure 121. The porous structure 121 has a pore diameter ranging between 0.01 μm and 5.0 μm and has a porosity ranging between 20% and 95%. The polytetrafluoroethylene film has an upper surface 11A and a lower surface 11B. The polytetrafluoroethylene film 1 has a thickness ranging between 1 μm and 50 μm, and is preferably made of expanded porous polytetrafluoroethylene. The polytetrafluoroethylene film 1 of this preferred embodiment is manufactured by mixing a suspension of polytetrafluoroethylene resin or a dispersion of polytetrafluoroethylene resin with at least one additive, and treating the above-mentioned resin by means of a stretching shaping method, thus obtaining the polytetrafluoroethylene film 1 composed of expanded porous polytetrafluoroethylene.

The aforementioned additive can be titanium dioxide, silicon dioxide, carbon black, nano carbon tube, inorganic oxide, or organic oxide, or a combination of the aforementioned materials.

After being mixed with at least one additive, the suspension of polytetrafluoroethylene resin or the dispersion of polytetrafluoroethylene resin is serially processed by the aforementioned stretching shaping method, which including the molding step, the extruding step, the calendaring step, the expanding step, the heat-setting step and cooling step, thereby the polytetrafluoroethylene film 1 composed of expanded porous polytetrafluoroethylene is obtained. Accordingly, the polytetrafluoroethylene film 1 of this preferred embodiment includes the porous layer 12 having the porous structure 121 via the foregoing stretching shaping method is obtained, wherein the porous structure 121 has a porosity ranging between 20% and 95%. Due to the extensive presence of the porous structure 121 in the polytetrafluoroethylene film 1, the density of the polytetrafluoroethylene film 1 is remarkably reduced, or in other words, the porosity of the polytetrafluoroethylene film 1 is remarkably increased. As a result, the polytetrafluoroethylene film 1 is endowed with additional advantageous features, including great flexibility, high porosity, low density and low dielectric constant.

The polymeric electret film 100 of this preferred embodiment has an electrode layer 2 formed on the lower surface 11B of the polytetrafluoroethylene film 1. The electrode layer 2 has a thickness ranging between 0.1 nm and 300 nm. Preferably, the thickness of the electrode layer 2 ranges between 50 nm and 150 nm. The process for forming the electrode layer on the lower surface 11B of the polytetrafluoroethylene film can be physical vapor deposition, sputtering, sputtering deposition, spin coating, immersion plating, or other semiconductor deposition process.

Since the principles of physical vapor deposition, sputtering, sputtering deposition, spin coating and immersion plating have been well known in the art, they are not need to be described in any length herein.

The electrode layer 2 of this preferred embodiment can be made of single or multiple materials, which can be metal oxide, metal, metal ion, carbon black, or nano carbon tube, or a combination of the aforementioned materials. The aforementioned metal oxide can be indium tin oxide (ITO), antimony tin oxide (ATO), zinc oxide (ZnO), tin oxide ($SnO_2$), indium oxide ($In_2O_3$), indium zinc oxide (IZO), aluminum-doped zinc oxide (AZO), gallium-doped zinc oxide (GZO), magnesium zinc oxide (MZO), zinc magnesium aluminum oxide (ZMAO), or zinc magnesium gallium oxide (ZMGO). In addition, the aforementioned metal or metal ion can be gold, silver, copper, aluminum, platinum, or chromium.

Figure 2:
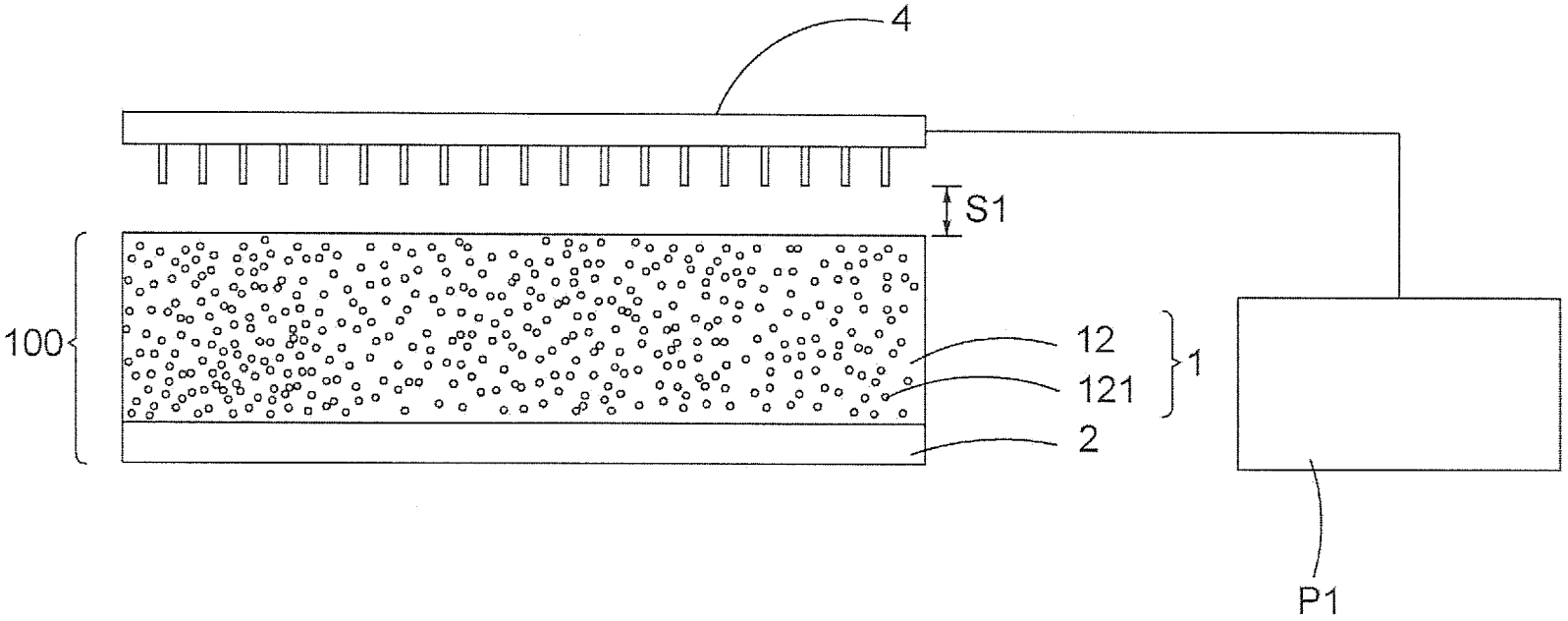
FIG. 2 is a schematic view showing a polymeric electret film of the first preferred embodiment of the present invention is charged by a corona charging method.

Please refer to FIG. 2, showing the polytetrafluoroethylene film 1 of the first preferred embodiment of the present invention is charged. In this embodiment, corona charging method, thermal charging method or electron beam charging method can be employed in order to charge the polytetrafluoroethylene film 1 and thereby form the polymeric electret film 100. Since the principles of corona charging method, thermal charging method and electron beam charging method for the electret have been well known in the art, they are not need to be described in any length here. People skilled in the art would appreciate that while the first preferred embodiment of the present invention herein recites corona charging method as a preferred solution for charging the polytetrafluoroethylene film 1 to form the polymeric electret film 100; however, it is noted that corona charging method is not recited here for purposes of limitation, many other solutions for charging may be applicable to the polytetrafluoroethylene film 1 of the first preferred embodiment of the present invention.

In this preferred embodiment, a needle electrode 4 is disposed above the upper surface 11A of the polytetrafluoroethylene film 1 with a preset clearance S1 between the needle electrode 4 and the polytetrafluoroethylene film 1, wherein the preset clearance S1 ranges between 0.1 mm and 200 mm. The polytetrafluoroethylene film 1 is charged via the needle electrode 4 by a corona charging method at a preset first temperature ranging between 1° C. and 40° C. for a preset first period of time ranging between 0.1 seconds and 50 seconds, wherein the corona charging method is conducted by applying a DC bias voltage P1 to the polytetrafluoroethylene film 1. Next, the polytetrafluoroethylene film 1 is cured at a preset second temperature ranging between 31° C. and 99° C. for a preset second period of time ranging between 0.5 hours and 20 hours, thereby the polymeric electret film 100 having a surface potential ranging between 0.1 V and 1000 V is formed. Preferably, the surface potential of the polymeric electret film 100 ranges between 100 V and 1000 V.

In the above-mentioned corona charging method, the parameters are set as follows:

The preset clearance S1 is preferably 50 mm; The first temperature preferably ranges between 10° C. and 30° C.; The DC bias voltage P1 can be a positive DC bias voltage ranging between 0.1 kV and 1000 kV, and preferably ranging between 1 kV and 100 kV; The DC bias voltage P1 can be a negative DC bias voltage ranging between −0.1 kV and −1000 kV, and preferably ranging between −1 kV and −100 kV; The first period of time preferably ranges between 1 second and 15 seconds; The second temperature preferably ranges between 70° C. and 90° C.; The second period of time preferably ranges between 5 hours and 10 hours.

Figure 3:
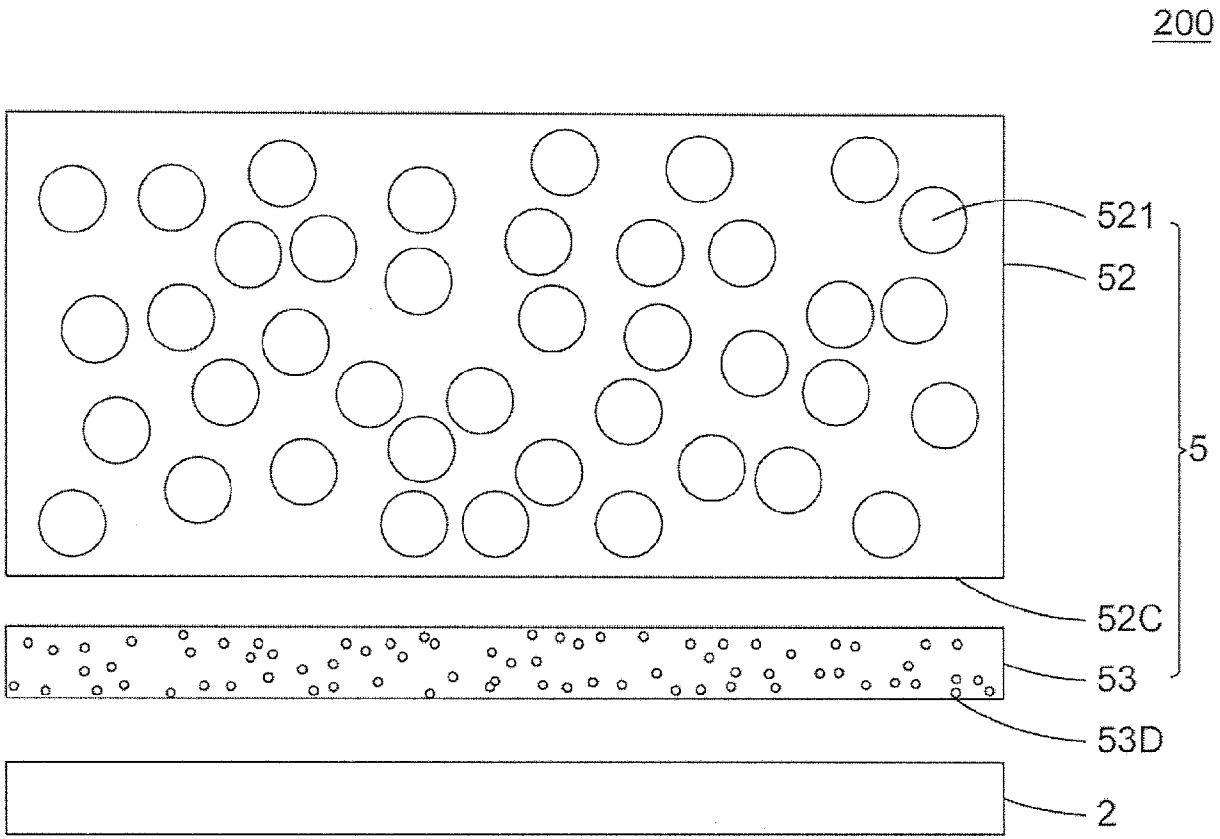
FIG. 3 is a cross-sectional view of another polymeric electret film according to the second preferred embodiment of the present invention.

Please refer to FIG. 3. The second preferred embodiment of the present invention is a polymeric electret film 200. The polymeric electret film 200 comprises a polytetrafluoroethylene film 5 and an electrode layer 2. The polytetrafluoroethylene film 5 includes a porous layer 52 and a dense layer 53, wherein the porous layer 52 possess the same features as those described in the first preferred embodiment.

As compared to the first preferred embodiment, the polytetrafluoroethylene film 5 of the second preferred embodiment further comprises a dense layer 53 formed on the lower side 52C of the porous layer 52. A electrode layer 2 is formed on the lower side 53D of the dense layer 53; The dense layer 53 has a thickness which is 0.04% to 40% of the thickness of the polytetrafluoroethylene film 5; The dense layer 53 has a surface roughness Ra ranging between 20 nm and 165 nm; The dense layer 53 has a contact angle for water ranging between 120° and 135°.

The polytetrafluoroethylene film 5 of this preferred embodiment is similarly manufactured as those stated in the first preferred embodiment. More particularly, it must be noted that the polytetrafluoroethylene film 5 comprising the porous layer 52 and the dense layer 53 is manufactured by heating one side of a thin polytetrafluoroethylene material which is homogeneous and porous, to a surface temperature higher than the melting point of the thin polytetrafluoroethylene material; and rapidly cooling the other side of the thin polytetrafluoroethylene material; thereby the polytetrafluoroethylene film 5 comprising the porous layer 52 and the dense layer 53 is obtained.

In this second preferred embodiment, the features in which the polytetrafluoroethylene film 5 is charged through corona charging method to have its surface potential are substantially the same as those described previously in the first preferred embodiment, and need not to be further stated herein.

Figure 4:
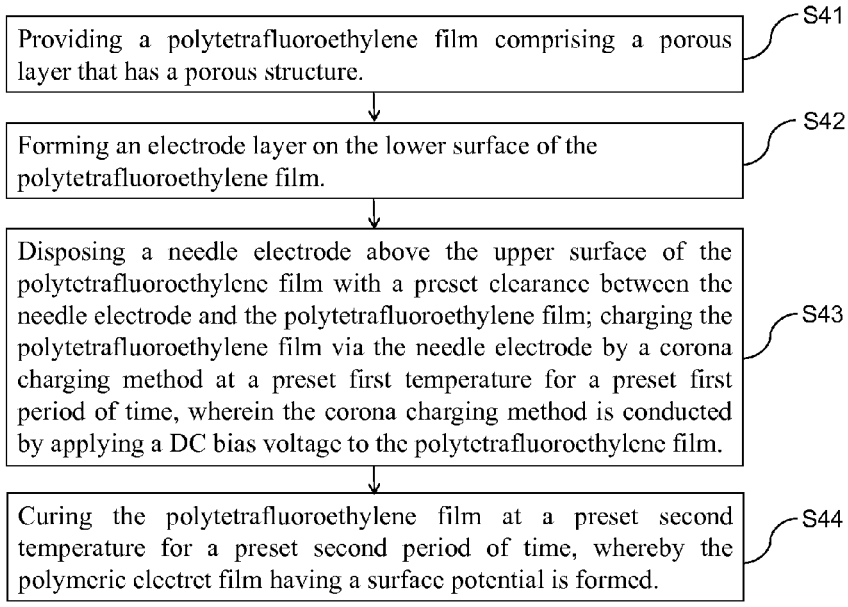
FIG. 4 is a flowchart illustrating a method for manufacturing a polymeric electret film according to the third preferred embodiment of the present invention.

Please refer to FIG. 4. The third preferred embodiment of the present invention is a flowchart illustrating a method for manufacturing a polymeric electret film 100.

Referring both to FIG. 1 and FIG. 4, as demonstrated in the step S41, a polytetrafluoroethylene film 1 comprising a porous layer 12 that has a porous structure 121 is provided. Preferably, the polytetrafluoroethylene film 1 is made of expanded porous polytetrafluoroethylene. It is noted that the process of obtaining the polytetrafluoroethylene film 1 made of expanded porous polytetrafluoroethylene is substantially the same as that mentioned in the first preferred embodiment.

The porous structure 121 has a pore diameter ranging between 0.01 μm and 5.0 μm and has a porosity ranging between 20% and 95%. The polytetrafluoroethylene film 1 has a thickness ranging between 1 μm and 50 μm, and is preferably made of expanded porous polytetrafluoroethylene. The polytetrafluoroethylene film 1 of this preferred embodiment is manufactured by mixing a suspension of polytetrafluoroethylene resin or a dispersion of polytetrafluoroethylene resin with at least one additive, and treating the above-mentioned resin by means of an stretching shaping method, thus obtaining the polytetrafluoroethylene film 1 composed of expanded porous polytetrafluoroethylene.

The aforementioned additive can be titanium dioxide, silicon dioxide, carbon black, nano carbon tube, inorganic oxide, or organic oxide, or a combination of the aforementioned materials.

After being mixed with at least one additive, the suspension of polytetrafluoroethylene resin or the dispersion of polytetrafluoroethylene resin is serially processed by the aforementioned stretching shaping method, which including the molding step, the extruding step, the calendaring step, the expanding step, the heat-setting step and cooling step, thereby the polytetrafluoroethylene film 1 composed of expanded porous polytetrafluoroethylene is obtained. Accordingly, the polytetrafluoroethylene film 1 of this preferred embodiment includes the porous layer 12 having the porous structure 121 via the foregoing stretching shaping method is obtained, wherein the porous structure 121 has a porosity ranging between 20% and 95%. Due to the extensive presence of the porous structure 121 in the polytetrafluoroethylene film 1, the density of the polytetrafluoroethylene film 1 is remarkably reduced, or in other words, the porosity of the polytetrafluoroethylene film 1 is remarkably increased. As a result, the polytetrafluoroethylene film 1 is endowed with additional advantageous features, including great flexibility, high porosity, low density and low dielectric constant.

Next, in the step S42, an electrode layer 2 is formed on the lower surface 11B of the polytetrafluoroethylene film 1.

The electrode layer 2 has a thickness ranging between 0.1 nm and 300 nm. Preferably, the thickness of the electrode layer 2 ranges between 50 nm and 150 nm. The process for forming the electrode layer on the lower surface 11B of the polytetrafluoroethylene film can be physical vapor deposition, sputtering, sputtering deposition, spin coating, immersion plating, or other semiconductor deposition process.

Since the principles of physical vapor deposition, sputtering, sputtering deposition, spin coating and immersion plating have been well known in the art, they are not need to be described in any length herein.

The electrode layer 2 of this preferred embodiment can be made of single or multiple materials, which can be metal oxide, metal, metal ion, carbon black, or nano carbon tube, or a combination of the aforementioned materials. The aforementioned metal oxide can be indium tin oxide (ITO), antimony tin oxide (ATO), zinc oxide (ZnO), tin oxide ($SnO_2$), indium oxide ($In_2O_3$), indium zinc oxide (IZO), aluminum-doped zinc oxide (AZO), gallium-doped zinc oxide (GZO), magnesium zinc oxide (MZO), zinc magnesium aluminum oxide (ZMAO), or zinc magnesium gallium oxide (ZMGO). In addition, the aforementioned metal or metal ion can be gold, silver, copper, aluminum, platinum, or chromium.

Next, in the step S43, a needle electrode 4 is disposed above the upper surface 11A of the polytetrafluoroethylene film 1 with a preset clearance S1 between the needle electrode 4 and the polytetrafluoroethylene film 1, wherein the preset clearance S1 ranges between 0.1 mm and 200 mm. The polytetrafluoroethylene film 1 is charged via the needle electrode 4 by a corona charging method at a preset first temperature ranging between 1° C. and 40° C. for a preset first period of time ranging between 0.1 seconds and 50 seconds, wherein the corona charging method is conducted by applying a DC bias voltage P1 to the polytetrafluoroethylene film 1.

Next, in the step S44, the polytetrafluoroethylene film 1 is cured at a preset second temperature ranging between 31° C. and 99° C. for a preset second period of time ranging between 0.5 hours and 20 hours, thereby the polymeric electret film 100 having a surface potential ranging between 0.1 V and 1000 V is formed. Preferably, the surface potential of the polymeric electret film 100 ranges between 100 V and 1000 V.

In the above-mentioned step S43 and step S44, the parameters are set as follows:

The preset clearance S1 is preferably 50 mm; The first temperature preferably ranges between 10° C. and 30° C.; The DC bias voltage P1 can be a positive DC bias voltage ranging between 0.1 kV and 1000 kV, and preferably ranging between 1 kV and 100 kV; The DC bias voltage P1 can be a negative DC bias voltage ranging between −0.1 kV and −1000 kV, and preferably ranging between −1 kV and −100 kV; The first period of time preferably ranges between 1 second and 15 seconds; The second temperature preferably ranges between 70° C. and 90° C.; The second period of time preferably ranges between 5 hours and 10 hours.

Figure 5:
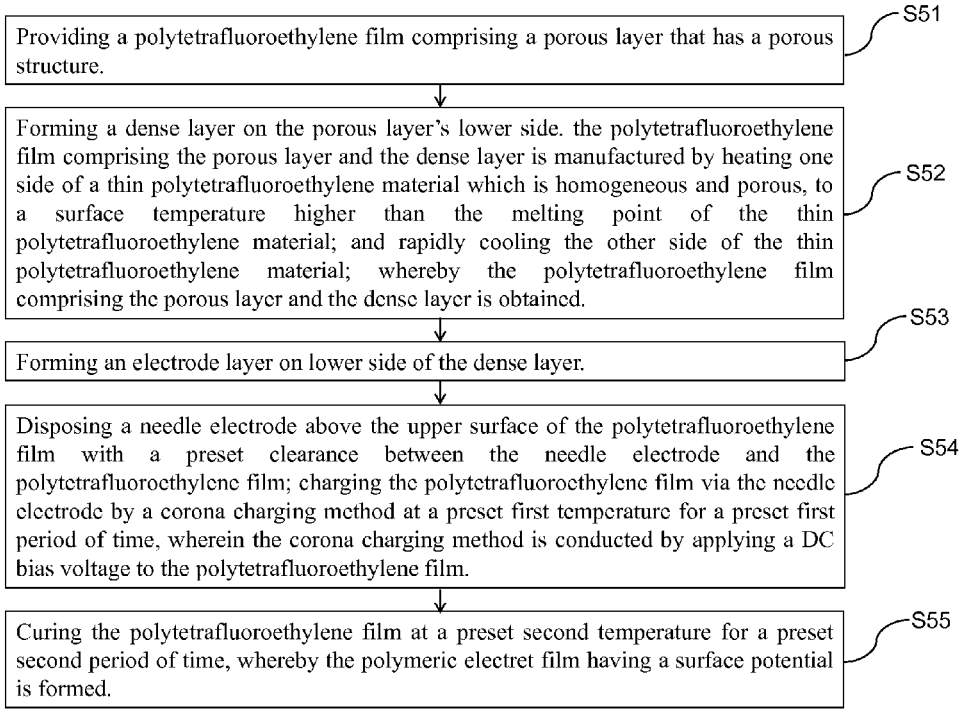
FIG. 5 is a flowchart illustrating a method for manufacturing a polymeric electret film according to the fourth preferred embodiment of the present invention.

Please refer to FIG. 5. The fourth preferred embodiment of the present invention is a flowchart illustrating a method for manufacturing a polymeric electret film 200.

Please refer to both FIG. 3 and FIG. 5, as demonstrated in the step S51, a polytetrafluoroethylene film 5 comprising a porous layer 52 that has a porous structure 521 is provided. Preferably, the polytetrafluoroethylene film 5 is made of expanded porous polytetrafluoroethylene.

The porous structure 121 has a pore diameter ranging between 0.01 μm and 5.0 μm and has a porosity ranging between 20% and 95%. The polytetrafluoroethylene film 1 has a thickness ranging between 1 μm and 50 μm, and is preferably made of expanded porous polytetrafluoroethylene. It is noted that the process of obtaining the polytetrafluoroethylene film 5 made of expanded porous polytetrafluoroethylene is substantially the same as that described in the step S41 of the fourth preferred embodiment.

Next, in the step S52, a dense layer 53 formed on the lower side 52C of the porous layer 52.

The dense layer 53 has a thickness which is 0.04% to 40% of the thickness of the polytetrafluoroethylene film 5; The dense layer 53 has a surface roughness Ra ranging between 20 nm and 165 nm; The dense layer 53 has a contact angle for water ranging between 120° and 135°.

The polytetrafluoroethylene film 5 comprising the porous layer 52 and the dense layer 53 is manufactured by heating one side of a thin polytetrafluoroethylene material which is homogeneous and porous, to a surface temperature higher than the melting point of the thin polytetrafluoroethylene material; and rapidly cooling the other side of the thin polytetrafluoroethylene material; thereby the polytetrafluoroethylene film 5 comprising the porous layer 52 and the dense layer 53 is obtained.

Next, in the step S53, a electrode layer 2 is formed on the lower side 53D of the dense layer 53.

Next, in the step S54, a needle electrode 4 is disposed above the upper surface 11A of the polytetrafluoroethylene film 1 with a preset clearance S1 between the needle electrode 4 and the polytetrafluoroethylene film 1, wherein the preset clearance S1 ranges between 0.1 mm and 200 mm. The polytetrafluoroethylene film 1 is charged via the needle electrode 4 by a corona charging method at a preset first temperature ranging between 1° C. and 40° C. for a preset first period of time ranging between 0.1 seconds and 50 seconds, wherein the corona charging method is conducted by applying a DC bias voltage P1 to the polytetrafluoroethylene film 1.

Next, in the step S55, the polytetrafluoroethylene film 1 is cured at a preset second temperature ranging between 31° C. and 99° C. for a preset second period of time ranging between 0.5 hours and 20 hours, thereby the polymeric electret film 100 having a surface potential between 0.1 V and 1000 V is formed. Preferably, the surface potential of the polymeric electret film 200 ranges between 100 V and 1000 V.

The parameters of the above-mentioned step S54 and step S55 are substantially identical to those stated in the step S43 and step S44 of the third preferred embodiment.

To further demonstrating how the polymeric electret film 100 of the present invention significantly attenuates the decay rate of the surface potential of the polymeric electret film, three experimental examples are provided below.

Experimental Example 1

Figure 6A:
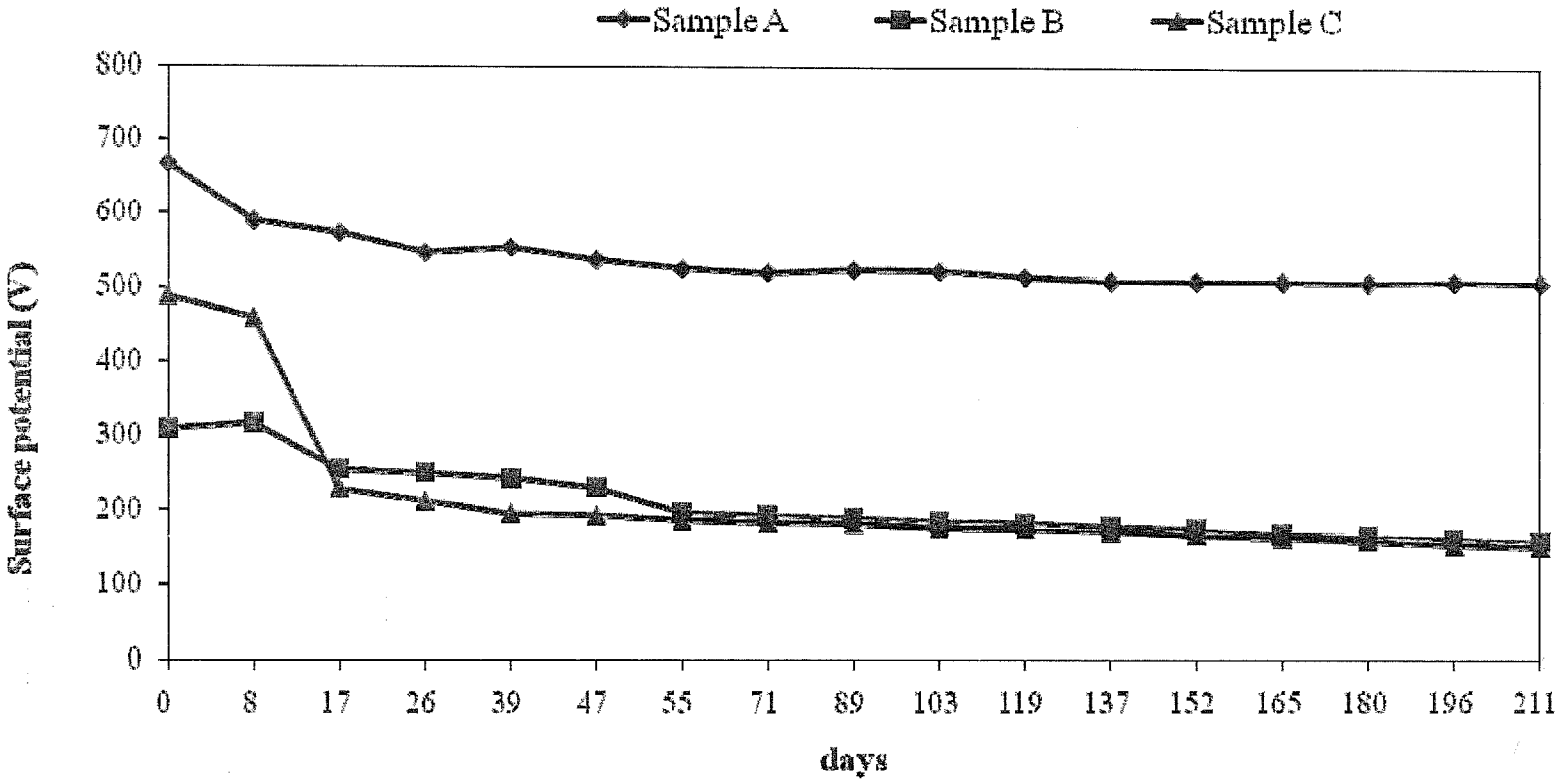
FIG. 6A is a chart showing the results of the surface potential and the charge stability of the polymeric electret film of the first preferred embodiment's experimental example 1.

Please refer to both FIGS. 6A and 6B. The polymeric electret film 100 of the present experimental example 1 is a polymeric electret film 100 according to the first preferred embodiment of the present invention.

Therein, the polytetrafluoroethylene film 1 of the polymeric electret film 100 was made of expanded porous polytetrafluoroethylene as described previously in the first preferred embodiment.

In addition, the experimental example 1 also adopted polytetrafluoroethylene and fluorinated ethylene-propylene as the material of which the polytetrafluoroethylene film 1 was made of.

Accordingly, there were three types of the polymeric electret film 100 in the experimental example 1, including:

1. Sample A: the polytetrafluoroethylene film 1 made of expanded porous polytetrafluoroethylene, with a thickness of 15 μm;
2. Sample B: the polytetrafluoroethylene film 1 made of polytetrafluoroethylene, with a thickness of 15 μm; and
3. Sample C: the polytetrafluoroethylene film 1 made of fluorinated ethylene-propylene, with a thickness of 12.5 μm.

After Sample A, Sample B and Sample C were prepared by the process described in the first preferred embodiment, the corona charging method was conducted thereto, respectively. Therein, the parameters for the corona charging method were the preset clearance S1 of 50 mm, the first temperature of 25° C., the negative bias voltage of −14 kV, the first period of time of 10 seconds, the second temperature of 90° C., and the second period of time of 8 hours.

After being charged, three types of the polymeric electret film 100 in the experimental example 1 became a polarized dielectric of a metastable state, with a relatively long relaxation time. When the additional electric field (namely the negative bias voltage in the experimental example 1) was removed, the surface charge of three types of the polymeric electret film 100 gradually reduced when they were allowed to stand at room temperature for days.

Sample A, Sample B and Sample C were continuously measured for surface potential at room temperature at predetermined times, respectively. The results are shown in FIG. 6A and FIG. 6B.

FIG. 6A displays the surface potential (V) of three types of the polymeric electret film 100 obtained in above-mentioned way, the surface potential (V) being plotted against days for which three types of the polymeric electret film 100 was allowed to stand at room temperature.

As shown in FIG. 6A and FIG. 6B, after being charged by the corona charging method, the surface potential of Sample A can only decay to about 14.1% of the initial value when standing for approximately 17 days from polarization at room temperature. However, the surface potential of Sample B and Sample C respectively decay to 17.5% and 53.2% of the initial value when standing for approximately 17 days from polarization at room temperature. In addition, the surface potential of Sample A can only decay to about 21.4% of the initial value when standing for approximately 55 days from polarization at room temperature, while that of Sample B and Sample C respectively decay to 36.5% and 62.1% of the initial value under the same storage condition as Sample A does. Moreover, the decay rate of Sample A's surface potential maintained in a stable value when standing for approximately 55 days to 211 days from polarization at room temperature. It is noteworthy that the surface potential of Sample A can only decay to about 24.0% of the initial value when standing for approximately 211 days from polarization at room temperature. Likewise, the decay rate of Sample B's and Sample C's surface potential also maintained in a stable value when standing for approximately 55 days to 211 days from polarization at room temperature. Nevertheless, compared with Sample A, the surface potential of Sample B and Sample C has already respectively decayed to 48.4% and 69.1% of the initial value when standing for approximately 211 days from polarization at room temperature, showing efficacy of the inventive polymeric electret film 100 (Sample A) improving the polarized initial surface potential and lower the surface potential decay rate, thereby achieving the objects of the present invention.

More particularly, the polymeric electret film 100 of the present experimental example 1, namely Sample A, had its polytetrafluoroethylene film 1 made of expanded porous polytetrafluoroethylene. Such polytetrafluoroethylene film 1, after being processed by the stretching shaping method, formed the extensive porous structure 121 that significantly increased the surface area of the polytetrafluoroethylene film 1. Thereby, after applying the high-voltage corona charging method to the present experimental example 1, the polymeric electret film 100 (Sample A) was capable of retaining a certain level of charges, thus improving the charge storage of the polymeric electret film 100 for a long period of time. Additionally, in an endurance test of the polymeric electret film 100 (Sample A), it was found that the surface potential of the polymeric electret film 100 (Sample A) scarcely attenuated even after the lapse of 211 days. This demonstrates that such high surface potential and high stability could be simultaneously obtained by using expanded porous polytetrafluoroethylene as the material of the polymeric electret film 100.

When the polytetrafluoroethylene film 1 of the polymeric electret film 100 was made of polytetrafluoroethylene or fluorinated ethylene-propylene instead of expanded porous polytetrafluoroethylene, Sample B or Sample C was provided. The alternative types of film had no porous structure 121. Thus, to the polytetrafluoroethylene film and the fluorinated ethylene-propylene film, the strong C-F polar bond is the only and sole resource of their charge traps.

However, in the expanded porous polytetrafluoroethylene material, in addition to the strong C-F polar bond, the porous structure 121 also contributes more charge traps in virtue of its plentiful clearances and microcrystal interface. Consequently, the expanded porous polytetrafluoroethylene material surpasses the polytetrafluoroethylene film and the fluorinated ethylene-propylene film in charge storage capability.

Accordingly, the results of the present experimental example 1 showed that the expanded porous polytetrafluoroethylene material with the porous structure 121 was different from the polytetrafluoroethylene and fluorinated ethylene-propylene materials in trapping abilities for negative and positive charges. In the experimental example 1, a negative bias voltage was applied for corona charging, so the better thermal stability was achieved. The different levels of the surface potential attenuation reflected the complexity of existing forms and distribution patterns of electret charges in different materials. Meanwhile, it was proven that the expanded porous polytetrafluoroethylene material of the present invention exactly endowed the improved charge storage capability to the polymeric electret film 100 of the present invention.

Experimental Example 2

Figure 7A:
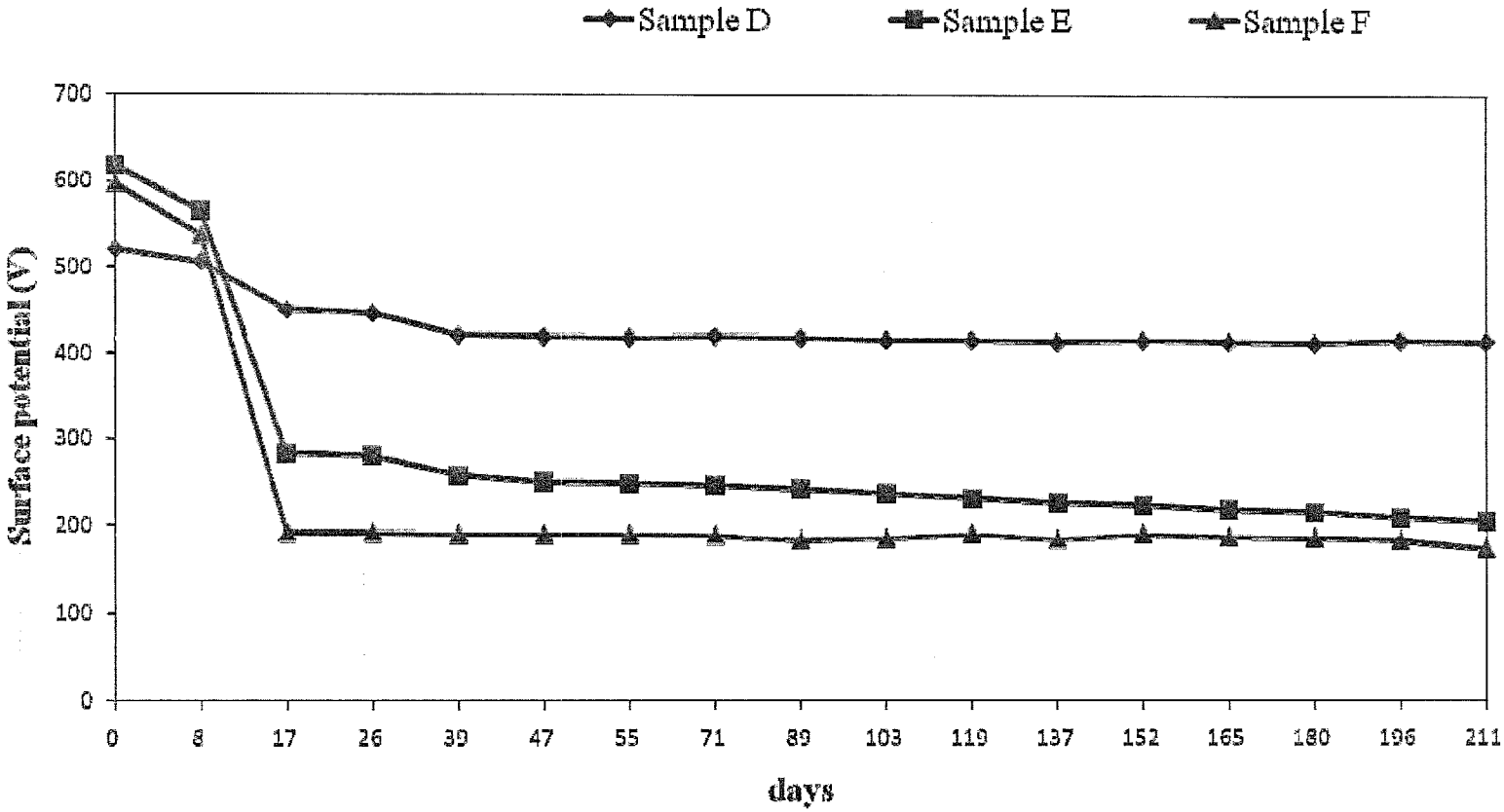
FIG. 7A is a chart showing the results of the surface potential and the charge stability of the polymeric electret film of the first preferred embodiment's experimental example 2.

Please refer to both FIGS. 7A and 7B. The polymeric electret film 100 of the present experimental example 2 is a polymeric electret film 100 according to the first preferred embodiment of the present invention.

Therein, the polytetrafluoroethylene film 1 of the polymeric electret film 100 was made of expanded porous polytetrafluoroethylene as described previously in the first preferred embodiment.

In addition, the experimental example 2 also adopted polytetrafluoroethylene and fluorinated ethylene-propylene as the material of which the polytetrafluoroethylene film 1 was made of.

Accordingly, there were three types of the polymeric electret film 100 in the experimental example 2, including:

1. Sample D: the polytetrafluoroethylene film 1 made of expanded porous polytetrafluoroethylene, with a thickness of 25 μm;
2. Sample E: the polytetrafluoroethylene film 1 made of polytetrafluoroethylene, with a thickness of 25 μm; and
3. Sample F: the polytetrafluoroethylene film 1 made of fluorinated ethylene-propylene, with a thickness of 25 μm.

After Sample D, Sample E and Sample F were prepared by the process described in the first preferred embodiment, the corona charging method was conducted thereto, respectively. Therein, the parameters for the corona charging method were the preset clearance S1 of 50 mm, the first temperature of 25° C., the negative bias voltage of −14 kV, the first period of time of 10 seconds, the second temperature of 90° C., and the second period of time of 8 hours.

After being charged, three types of the polymeric electret film 100 in the experimental example 2 became a polarized dielectric of a metastable state, with a relatively long relaxation time. When the additional electric field (namely the negative bias voltage in the experimental example 2) was removed, the surface charge of three types of the polymeric electret film 100 gradually reduced when they were allowed to stand at room temperature for days.

Sample D, Sample E and Sample F were continuously measured for surface potential at room temperature at predetermined times, respectively. The results are shown in FIG. 7A and FIG. 7B.

FIG. 7A displays the surface potential (V) of three types of the polymeric electret film 100 obtained in above-mentioned way, the surface potential (V) being plotted against days for which three types of the polymeric electret film 100 was allowed to stand at room temperature.

As shown in FIG. 7A and FIG. 7B, after being charged by the corona charging method, the surface potential of Sample D can only decay to about 13.6% of the initial value when standing for approximately 17 days from polarization at room temperature. However, the surface potential of Sample E and Sample F respectively decay to 54.5% and 68.0% of the initial value when standing for approximately 17 days from polarization at room temperature. In addition, the surface potential of Sample D can only decay to about 19.7% of the initial value when standing for approximately 55 days from polarization at room temperature, while that of Sample E and Sample F respectively decay to 59.8% and 68.2% of the initial value under the same storage condition as Sample D does. Moreover, the decay rate of Sample D's surface potential maintained in a stable value when standing for approximately 55 days to 211 days from polarization at room temperature. It is noteworthy that the surface potential of Sample D can only decay to about 20.3% of the initial value when standing for approximately 211 days from polarization at room temperature. Likewise, the decay rate of Sample E's and Sample F's surface potential also maintained in a stable value when standing for approximately 55 days to 211 days from polarization at room temperature. Nevertheless, compared with Sample D, the surface potential of Sample E and Sample F has already respectively decayed to 66.8% and 70.8% of the initial value when standing for approximately 211 days from polarization at room temperature, showing efficacy of the inventive polymeric electret film 100 (Sample D) improving the polarized initial surface potential and lower the surface potential decay rate, thereby achieving the objects of the present invention.

More particularly, the polymeric electret film 100 of the present experimental example 2, namely Sample D, obtained similar results to those obtained in experimental example 1.

Experimental Example 3

Figure 8A:
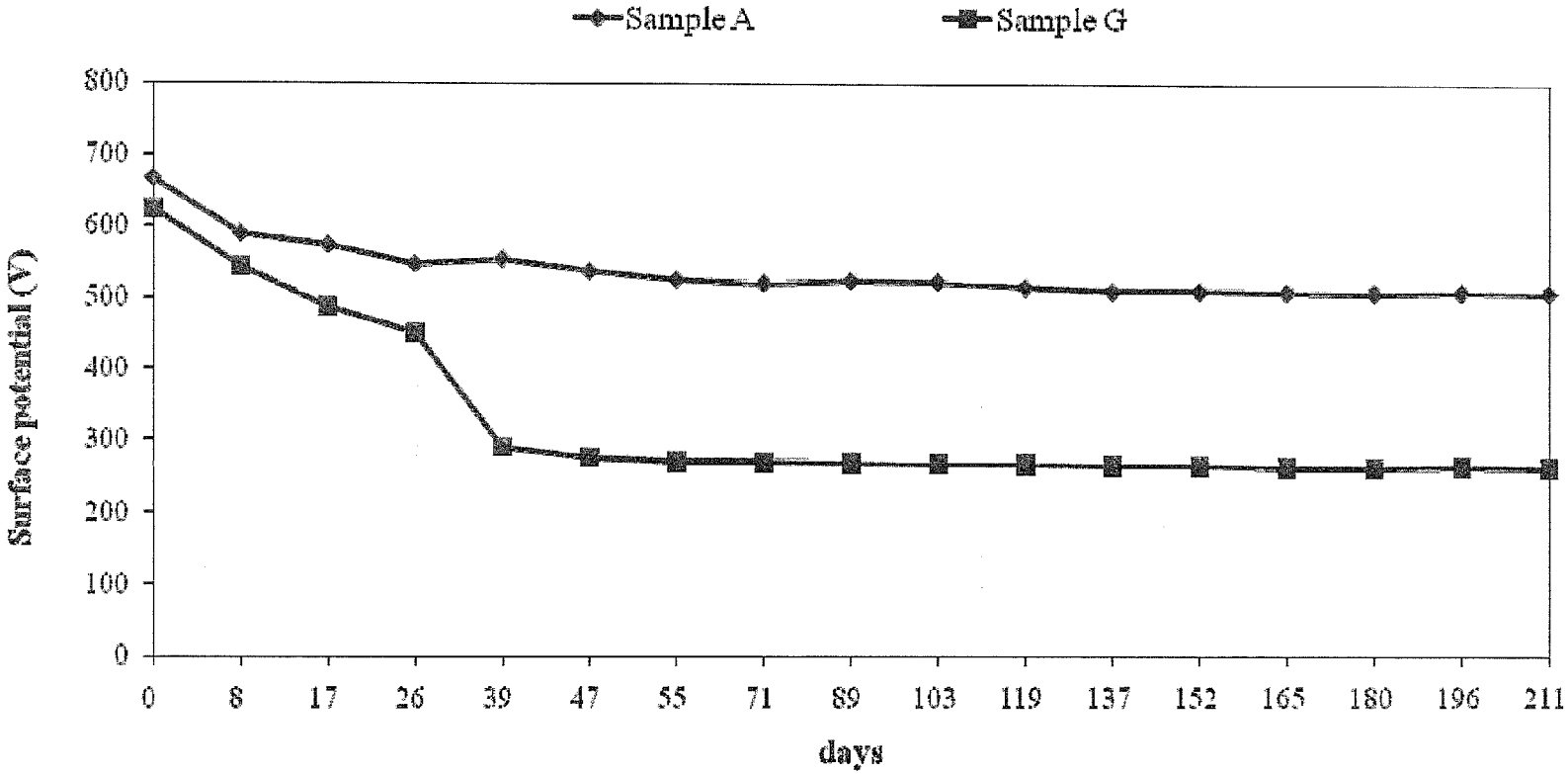
FIG. 8A is a chart showing the results of the surface potential and the charge stability of the polymeric electret film of the first preferred embodiment's experimental example 3.

Please refer to both FIGS. 8A and 8B. The polymeric electret film 100 of the present experimental example 3 is a polymeric electret film 100 according to the first preferred embodiment of the present invention.

Therein, the polytetrafluoroethylene film 1 of the polymeric electret film 100 was made of expanded porous polytetrafluoroethylene as described previously in the first preferred embodiment.

There were two types of the polymeric electret film 100 in the experimental example 3, including:

1. Sample A: the polytetrafluoroethylene film 1 made of expanded porous polytetrafluoroethylene, with a thickness of 15 μm; and
2. Sample G: the polytetrafluoroethylene film 1 made of polytetrafluoroethylene, with a thickness of 10 μm; and After Sample A and Sample G were prepared by the process described in the first preferred embodiment, the corona charging method was conducted thereto, respectively. Therein, the parameters for the corona charging method were the preset clearance S1 of 50 mm, the first temperature of 25° C., the negative bias voltage of −14 kV, the first period of time of 10 seconds, the second temperature of 90° C., and the second period of time of 8 hours.

After being charged, two types of the polymeric electret film 100 in the experimental example 3 became a polarized dielectric of a metastable state, with a relatively long relaxation time. When the additional electric field (namely the negative bias voltage in the experimental example 3) was removed, the surface charge of three types of the polymeric electret film 100 gradually reduced when they were allowed to stand at room temperature for days.

Sample A and Sample G were continuously measured for surface potential at room temperature at predetermined times, respectively. The results are shown in FIGS. 8A and 8B.

FIG. 8A displays the surface potential (V) of two types of the polymeric electret film 100 obtained in above-mentioned way, the surface potential (V) being plotted against days for which two types of the polymeric electret film 100 was allowed to stand at room temperature.

As shown in FIG. 8A and FIG. 8B, after being charged by the corona charging method, the surface potential of Sample A can only decay to about 14.1% of the initial value when standing for approximately 17 days from polarization at room temperature. However, the surface potential of Sample G decayed to 22.5% of the initial value when standing for approximately 17 days from polarization at room temperature. In addition, the surface potential of Sample A can only decay to about 17.0% of the initial value when standing for approximately 55 days from polarization at room temperature, while that of Sample G decayed to 53.7% of the initial value under the same storage condition as Sample A does. Moreover, the decay rate of Sample A's surface potential maintained in a stable value when standing for approximately 55 days to 211 days from polarization at room temperature. It is noteworthy that the surface potential of Sample A can only decay to about 24.0% of the initial value when standing for approximately 211 days from polarization at room temperature. Likewise, the decay rate of Sample G's surface potential also maintained in a stable value when standing for approximately 55 days to 211 days from polarization at room temperature. Nevertheless, compared with Sample A, the surface potential of Sample G has already decayed to 58.0% of the initial value when standing for approximately 211 days from polarization at room temperature.

It is noteworthy that the two types of the polymeric electret film 100 of the experimental example 3, namely Sample A and Sample G, both had the polytetrafluoroethylene film 1 made of expanded porous polytetrafluoroethylene while the only difference there between relied on the thicknesses, wherein Sample A was 15 μm and Sample G was 10 μm. Porosity is herein used to express the density of porous structure 121 distributed in the expanded porous polytetrafluoroethylene material after said stretching shaping method. In this experimental example 3, Sample A had a thickness of 15 μm and a porosity of 85% while Sample G had a thickness of 10 μm and a porosity of 50%.

The results of the experimental example 3 demonstrate that the thickness of the polytetrafluoroethylene film 1 made of expanded porous polytetrafluoroethylene is highly related to the resultant porosity of the stretching shaping formed film. The present experimental example 3 also proves that the higher porosity increased the surface area of the polytetrafluoroethylene film 1 made of the expanded porous polytetrafluoroethylene film, thereby elevating the charge storage capacity of the polymeric electret film 100.

In summary, the present invention provides a method of manufacturing the polymeric electret film 100, and such obtained polymeric electret film 100 is capable of improving the polarized initial surface potential and lower the surface potential decay rate.

Therefore, the polymeric electret film 100 of the present invention is enabled to converse mechanical energy into acoustic energy or electric energy by means of vibration or compression, thus being applicable to piezoelectrical generators, super slim loud speakers (SSLSs), cap speakers and other related acoustic materials. Furthermore, the polymeric electret film 100 of the present invention can be extensively applicable throughout various industries including exercising equipment, acoustics, optics, biomedical treatment and electrics Although some particular embodiments of the invention have been described in detail for purposes of illustration, it will be understood by one of ordinary skill in the art that numerous variations will be possible to the disclosed embodiments without going outside the scope of the invention as disclosed in the claims.

What is claimed is:

1. A method of manufacturing a polymeric electret film comprising steps of:

mixing a suspension of polytetrafluoroethylene resin with at least one additive selected from the group consisting of titanium dioxide, silicon dioxide, carbon black, nano carbon tube, inorganic oxide and organic oxide;

stretching and shaping the suspension of polytetrafluoroethylene resin to form an expanded porous polytetrafluoroethylene (ePTFE) film having a first porous layer of a porous structure, wherein the first porous structure has a pore diameter ranging between 0.01 μm and 5.0 μm and has a porosity ranging between 20% and 95%, and the expanded porous polytetrafluoroethylene film has a first surface and an opposite surface;

forming a second porous layer by heating one side of a thin polytetrafluoroethylene material on the first porous layer's opposite surface to a surface temperature higher than the melting point of the thin polytetrafluoroethylene material and rapidly cooling the other side of the thin polytetrafluoroethylene material, wherein the second porous layer has a thickness which is 0.04% to 40% of the thickness of the expanded porous polytetrafluoroethylene film, a surface roughness Ra ranging between 20 nm and 165 nm and a contact angle for water ranging between 120° and 135°;

forming an electrode layer on the second porous layer's opposite surface, wherein the electrode layer has a thickness ranging between 0.1 nm and 300 nm;

disposing a needle electrode above the first surface of the expanded porous polytetrafluoroethylene film with a preset clearance between the needle electrode and the expanded porous polytetrafluoroethylene film, wherein the preset clearance ranges between 0.1 mm and 200 mm;

charging the expanded porous polytetrafluoroethylene film via the needle electrode by a corona charging method at a preset first temperature ranging between 10° C. and 30° C. for a preset first period of time ranging between 1 second and 15 seconds, wherein the corona charging method is conducted by applying a DC bias voltage to the expanded porous polytetrafluoroethylene film; and curing the expanded porous polytetrafluoroethylene film at a preset second temperature ranging between 70° C. and 90° C. for a preset second period of time ranging between 5 hours and 10 hours, whereby the polymeric electret film having a surface potential between 0.1 V and 1000 V is formed;

wherein a surface potential of the polymeric electret film decays to less than 24% of an initial value when standing for a period of time greater than 200 days from polarization at room temperature in an endurance test of the polymeric electret film.

2. The method of manufacturing the polymeric electret film according to claim 1, wherein the preset clearance is 50 mm.

3. The method of manufacturing the polymeric electret film according to claim 1, wherein the DC bias voltage is a positive bias voltage ranging between 0.1 kV and 1000 kV.

4. The method of manufacturing the polymeric electret film according to claim 3, wherein the positive bias voltage preferably ranges between 1 kV and 100 kV.

5. The method of manufacturing the polymeric electret film according to claim 1, wherein the DC bias voltage is a negative bias voltage ranging between −0.1 kV and −1000 kV.

6. The method of manufacturing the polymeric electret film according to claim 5, wherein the negative bias voltage preferably ranges between −1 kV and −100 kV.

7. The method of manufacturing the polymeric electret film according to claim 1, wherein the step of forming the electrode layer on the opposite surface of the expanded porous polytetrafluoroethylene film is performed by a process selected from the group consisting of physical vapor deposition, sputtering, sputtering deposition, spin coating, immersion plating and other semiconductor deposition process.

8. The method of manufacturing the polymeric electret film according to claim 1, wherein the electrode layer has a thickness ranging between 50 nm and 150 nm.

9. The method of manufacturing the polymeric electret film according to claim 1, wherein the electrode layer comprises metal oxide, which is selected from the group consisting of indium tin oxide (ITO), antimony tin oxide (ATO), zinc oxide (ZnO), tin oxide (SnO2), indium oxide (In2O3), indium zinc oxide (IZO), aluminum-doped zinc oxide (AZO), gallium-doped zinc oxide (GZO), magnesium zinc oxide (MZO), zinc magnesium aluminum oxide (ZMAO) and zinc magnesium gallium oxide (ZMGO).

10. The method of manufacturing the polymeric electret film according to claim 1, wherein the electrode layer comprises metal or metal ion, which is selected from the group consisting of gold, silver, copper, aluminum, platinum and chromium.

11. The method of manufacturing the polymeric electret film according to claim 1, wherein the electrode layer comprises carbon black or nano carbon tube.

12. The method of manufacturing the polymeric electret film according to claim 1, wherein the surface potential of the polymeric electret film ranges between 100 V and 1000 V.

13. The method of manufacturing the polymeric electret film according to claim 12, wherein the polymeric electret film has the surface potential ranging between 500 V and 700 V when the first temperature ranges between 10° C. and 30° C.

* * * * *